United States Patent [19]

de Vries et al.

[11] 4,027,186

[45] May 31, 1977

[54] GAS DISCHARGE DISPLAY DEVICE HAVING PLURAL GROUPS OF CATHODES

[75] Inventors: Gerhard Heinrich Friedrich de Vries; Johannes van Esdonk; Theunis Goos, all of Eindhoven, Netherlands

[73] Assignee: U.S. Philips Corporation, New York, N.Y.

[22] Filed: Mar. 31, 1976

[21] Appl. No.: 672,134

[30] Foreign Application Priority Data

Apr. 11, 1975 · Netherlands ..... 7504323

[52] U.S. Cl. ..... 313/217; 313/210

[51] Int. Cl.[2] ..... H01J 61/067

[58] Field of Search ..... 313/210, 514, 217, 188, 313/517

[56] References Cited

UNITED STATES PATENTS

| | | | |
|---|---|---|---|
| 3,949,261 | 4/1976 | Harvey | 313/188 |
| 3,961,217 | 6/1976 | Frischer | 313/188 |

*Primary Examiner*—Palmer C. Demeo

*Attorney, Agent, or Firm*—Frank R. Trifari; Carl P. Steinhauser

[57] ABSTRACT

A gas-discharge display device having a number of cathodes connected in groups and at least one common anode. The cathodes are arranged in a row extending parallel to the anode, each group consisting of spaced portions of a respective elongate conductor, the conductors being arranged in a staggered helix-like formation around a common core which has an insulating surface.

10 Claims, 7 Drawing Figures

GAS DISCHARGE DISPLAY DEVICE HAVING PLURAL GROUPS OF CATHODES

The invention relates to a gas-discharge display device having an envelope which consists at least partly of light-pervious material and which contains a plurality of cathodes and at least one elongate common anode the cathodes being arranged in a row extending substantially parallel to a said anode, being connected together in groups and each being operable to provide between the respective cathode and the anode a gas discharge visible through the light-previous material.

Such a gas-discharge device is known from "Electronics", Mar. 2, 1974, pp. 89 – 93. In such a device, glow discharges at the cathodes can be produced by applying suitable potential differences between the anode and the cathodes. By successively applying the suitable potentials to the different groups of cathodes, the cathodes arranged in a row are activated successively, so that the visual impression is gained of a glow discharge which moves along said row. By choosing the recurrence frequency with which the groups of cathodes are scanned successively to be sufficiently high, all those adjacent cathodes which are activated are observed as a light-radiating line or path. The number of activated cathodes starting from one end of the row, and hence the length of the light-radiating line or path formed by said cathodes, can be arranged to represent the value of a given quantity. Thus the gas-discharge device may be used as an indicating instrument.

As described in the above-mentioned article, the cathodes are connected together in groups, i.e. all the cathodes belonging to one and the same group are connected together electrically. The cathodes are thus driven not individually but in groups. However, of the cathodes driven simultaneously in one group, a glow discharge will be produced only at that cathode which is nearest to a cathode which belongs to another group and at which a glow discharge has just taken place. This phenomenon is due to the fact that during a discharge, metastable and ionised gas atoms are formed which can diffuse to an adjacent gas discharge cell. As a result, the gas in said adjacent cell is "pre-ionised", as it were, with the favourable result that in spite of the subsequent simultaneous driving of the cathodes of another group, a glow discharge is produced only at the cathode in the pre-ionised cell. A gas discharge cell is herein defined by a crossing of an anode and a cathode.

In the above-mentioned known gas-discharge device, the cathodes are provided on a ceramic substrate by means of a silk screening method. The adhesion of the cathode material thus provided, however, strongly depends upon the material of which the substrate consists. In addition, because in practical cases the cathodes are arranged in three or more groups, an electrically insulating layer must be provided between at least two successive groups so as to avoid a short-circuit between said groups.

It is an object of the invention to provide a gas-discharge device in which the above-mentioned problems are alleviated.

A gas-discharge device of the kind mentioned in the opening paragraph is characterized according to the invention in that each said group comprises a respective elongate conductor, spaced portions of which constitute said cathodes, the conductors extending substantially coaxially around and along a common core which has an insulating surface, being of substantially the same shape and being substantially uniformly spaced so that the row of cathodes comprises a cyclic succession of said portions of all the conductors. The portions of each conductor which constitute the cathodes are preferably regularly spaced along the length thereof.

A gas-discharge device embodying the invention can be manufactured in a simple manner. Furthermore, there are no severe restrictions on the choice of the cathode material, so that materials having properties which are favourable for a gas discharge may be chosen, and consequently the reliability and the life of the device can be increased.

The portions of the conductors which do not constitute said cathodes are preferably covered with an electrically insulating material at least adjacent the cathode portions so as to prevent a glow discharge from expanding over the surface of the conductors further than the cathode portions.

Suitably, the core has at least one elongate groove in which a said common anode is present. Said common anode may consist of a metal body or of electrically conductive material at the bottom of the groove. Said conductive material may be provided on the bottom of the groove in the form of an electrically conductive layer on the insulating surface. If the core is conductive and has an insulating surface, the conductive material may alternatively be obtained by removing the insulating surface from the bottom of the groove.

Furthermore, the conductors are arranged in grooves in the core at least adjacent each end of the cathode portions, said grooves extending substantially perpendicularly to the longitudinal direction of the anode so that the positions of the cathodes and their mutual separations are readily fixed.

The invention will be described in greater detail with reference to the diagrammatic drawings, in which.

Figure 1:
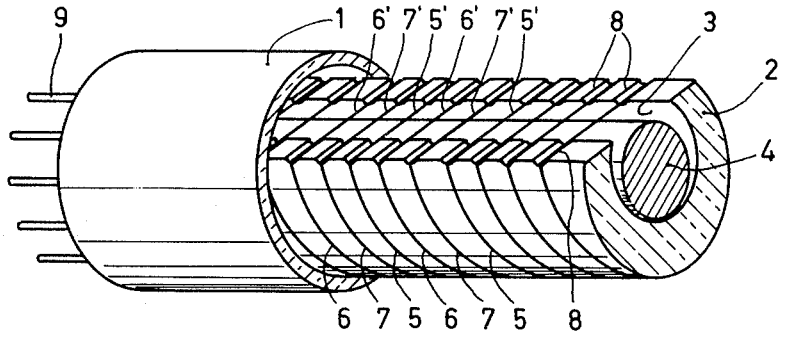
FIG. 1 is a perspective view, partly broken away, of part of a gas-discharge device embodying the invention.

The gas-discharge device shown in FIG. 1 has a glass envelope 1 in which is mounted a glass core 2 having a partly cylindrical outer surface of diameter of 6 mm and two coplanar faces separated by an elongate groove or recess 3 in which is a metal rod 4 consisting of molybdenum and having a diameter of 2 mm uniformly longitudinally spaced. Three molybdenum wires 5, 6 and 7, 0.2 mm thick, are each wound around and along the core 2 substantially in the form of a helix; each conductor has portions, denoted by 5', 6' and 7' respectively, at the regions where the wires cross the recess 3 which constitute cathodes for gas discharges and which are spaced by 0.2 mm from the conductor 4 serving as a common anode. The coplanar faces of the core 2 have grooves 8 extending perpendicularly to the longitudinal direction of the anode for fixing the wires 5, 6 and 7 at a distance of 0.6 mm from each other. Via a number of contact pins 9 sealed in the envelope 1, the desired potentials can be applied to the cathodes 5', 6' and 7′ and to the anode 4. Adjacent each end of the cathode portions 5′, 6′ and 7′, the wires 5, 6 and 7 are covered with an insulating layer of, for example, chromium oxide ($Cr_2O_3$), not shown in the drawing, so as to prevent a glow discharge produced at a cathode from expanding over the surface of the respective conductor further than that cathode.

Figure 2:
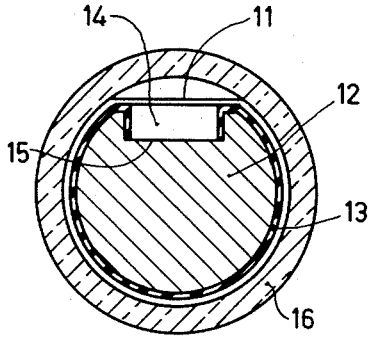
FIGS. 2, 3 and 4 are respective axial cross-sectional views of three different gas-discharge devices embodying the invention.

In the embodiment shown in FIG. 2, the cathode wires, of which one is shown and is referenced 11, are wound around an aluminum rod 12 having an aluminum oxide skin 13. The rod 12 has a longitudinally-extending groove 14 from the bottom 15 of which the aluminum oxide skin has been etched away. In this case, the aluminum rod itself is used as a common anode. The assembly is sealed from the atmosphere by a glass envelope 16 and is filled with a suitable ionisable gas, for example, argon, neon or a mixture thereof.

Figure 3:
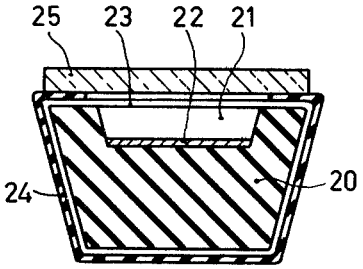

In the embodiment of FIG. 3, a common anode has been obtained by providing a metal layer 22 on the bottom of a longitudinal groove 21 in a ceramic core 20. Said metal layer may consist, for example, of a vapour-deposited or sputtered layer of aluminum, 20$\mu$m thick. With the exception of the cathode portions, such as 23, bridging the groove 21, the wires are covered with a fusing ceramic 24. To seal the discharge space, a glass plate 25 is connected to the ceramic core 20 in a vacuum-tight manner by means of the fusing ceramic 24.

Figure 4:
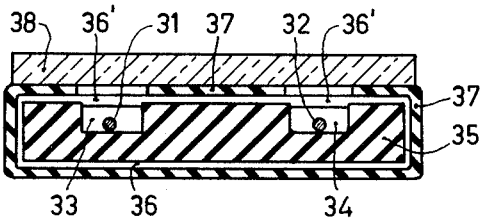

FIG. 4 shows a gas discharge device having two parallel anodes 31 and 32 which are respectively located in two parallel grooves 33 and 34 provided in an insulating core 35. The anodes 31 and 32 each constitute a respective common anode for three cathode wires which are wound beside each other around and along the core and one of which is shown and is referenced 36. With the exception of the cathode portions, such as 36′, bridging the grooves, the wires are similarly covered with an insulating layer 37 consisting of a crystallizing glass enamel which is provided on the surface of the core 35 initially in the form of a suspension. As in the embodiment of FIG. 3, the gas-discharge spaces which are filled with an ionisable gas one sealed from the atmosphere by a glass plate 38. By means of the device shown in FIG. 4, two quantities can be indicated simultaneously so that their values can immediately be compared with each other. In an analogous construction comprising more than two anodes, a number of quantities equal to the number of anodes can be visually compared with each other.

Figure 5:
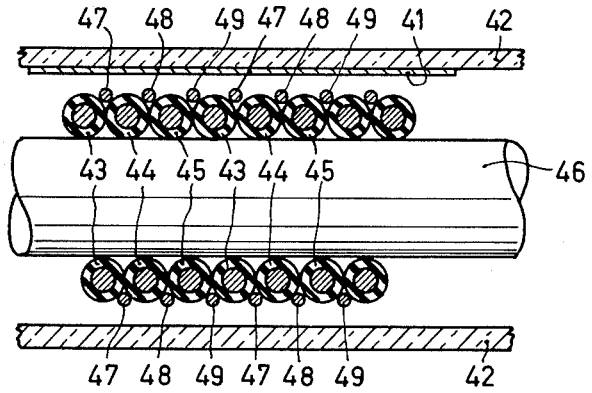
FIGS. 5 and 6 are respective longitudinal sectional views of two further embodiments of the invention.
Figure 6:
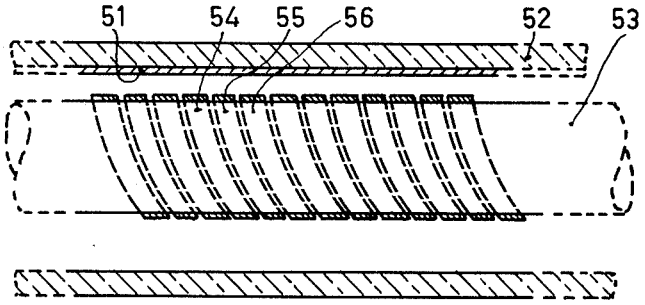

In the embodiments FIGS. 5 and 6, common anodes 41 and 51 are vapour-deposited on the inner walls of envelopes 42 and 52, respectively, in the form of light-pervious conductive strips of indium oxide or tin oxide. In the embodiment of FIG. 5, three wires 43, 44 and 45 of diameter 0.5 mm and having insulating layers on their surfaces are wound immediately adjacent each other around a cylindrical core 46. Said insulating layer consists of silicon nitride or a suitable polyimide. Three cathode wires 47, 48 and 49 are wound in the three helical grooves thus formed between the wires 43, 44 and 45. In the embodiment of FIG. 6, a continuous aluminum layer, 25$\mu$m thick, is vapour-deposited on a core 53 having an insulating surface, and the layer is divided into three separate helical conductors by cutting or etching away parts of the layer. Thus three cathode conductors 54, 55 and 56 which are insulated from each other are obtained. In a manner analogous to that described above, measures may be taken to restrict the expansion of a glow discharge over the cathode conductors, for example, by locally covering the conductors adjacent the cathode portions with a layer of chromium oxide ($Cr_2O_3$). Furthermore it is possible to provide a number of anodes in places distributed over the inner circumference of the envelopes 42 and 52 to enable different quantities to be indicated simultaneously, analogously to the embodiment shown in FIG. 4.

Figure 7:
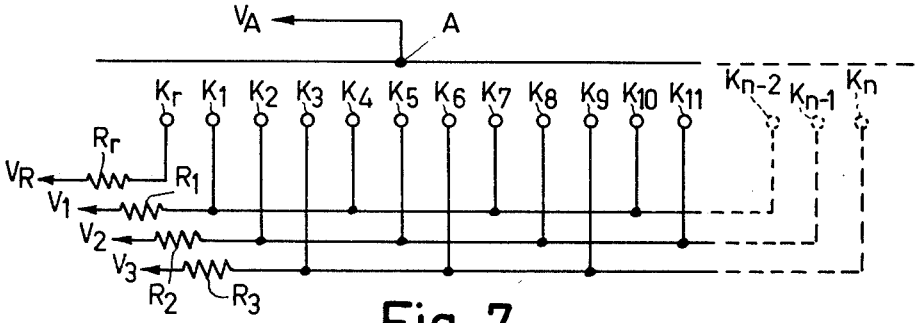
FIG. 7 shows schematically the way in which the electrodes can be operated in a gas-discharge device embodying the invention.

A method of operating the gas-discharge devices described will be explained with reference to FIG. 7. The cathodes are divided into a first group comprising the cathodes $K_1$, $K_4$, $K_7$ . . . , a second group comprising $K_2$, $K_5$, $K_8$ . . . , and a third group comprising $K_3$, $K_6$, $K_9$, . . . . A further cathode $K_r$ is an ignition cathode which also serves as a reset cathode. All cathodes have the anode A in common. By means of a scanning circuit, for example of the kind described in the above-cited article in "Electronics", the cathodes are driven with voltage pulses in the following manner. The anode A is maintained at a potential $V_A$ for a given period of time. Simultaneously with the increase of the anode voltage to $V_A$, the voltage $V_R$ applied through a resistor $R_r$ to cathode $K_r$ is lowered so that the voltage difference $V_A - V_R$ is sufficient to ignite $K_r$. After ignition, metastable and ionised gas atoms will diffuse to the adjacent gas discharge cell comprising the cathode $K_1$ so that said cell is set in a condition which is favourable for ignition. The potential at cathode $K_r$ is then raised to a quiescent value so that the discharge at $K_r$ is extinguished. A potential $V_1$ is applied to the first group of cathodes through a resistor $R_1$ so that $V_A - V_1$ is equal to or slightly larger than the required ignition voltage. Owing to the pre-ionized condition of the discharge cell comprising $K_1$, only that cathode of the first group of cathodes will ignite. As a result of the voltage drop across $R_1$ during the discharge, the potential at all cathodes of the first group is increased, while $K_1$ is operating, all so that the other cathodes of that group cannot ignite. During operation of $K_1$, ionized gas particles will similarly diffuse to $K_2$. The potential of the cathodes of the first group is then raised to a quiescent value, and a potential $V_2$ is applied through a resistor $R_2$ to the cathodes of the second group to bring them to ignition potential. For the reason already mentioned above, only $K_2$ of the second group of cathodes will ignite. The procedure is repeated for the third group of cathodes. The cathode groups are driven in sequence several times one after the other by means of the scanning circuit until the last cathode in the row, $K_n$, has been scanned, after which the reset cathode $K_r$ is driven and the whole cycle starts again. By ensuring that one cycle does not last longer than approximately 1/60 second, a continuous light-radiating line or path is observed owing to the persistence of vision of the human eye. The length of said line or path is determined by the length of time during which the anode potential $V_A$ is maintained at the anode A, i.e. the portion of the period of time which elapses between successive scans of the reset cathode $K_r$. The length of the light radiating line or path is thus a corresponding portion of the overall length of the row formed by the cathodes.

It should be noted that the way in which the gas-discharge device is operated falls beyond the scope of the present invention and has therefore been indicated schematically only.

Although the invention has been explained with reference to embodiments having cathodes connected in three groups, it is by no means restricted thereto. The cathodes may also be connected in more than three groups. The choice of the number of groups depends in general on the overall length of the row formed by the cathodes. The longer the row, the larger will the number of cathode groups have to be, since otherwise the time which is available for the deionisation of the gas used in the device becomes too short as a result of the necessarily more rapid scanning.

What is claimed is:

1. A gas-discharge display device having an envelope at least part of which is a light-pervious material, a plurality of cathodes and at least one elongate common anode supported within said envelope, an ionizable medium within said envelope, the cathodes being arranged in a row extending substantially parallel to a said anode, said cathodes being spaced from said anode and being connected together in groups and each being operable to provide between the respective cathode and the anode a gas discharge visible through the light-pervious material, each said group comprising a respective elongate conductor, spaced portions of which constitute said cathodes, the conductors extending substantially coaxially around and along a common core which has an insulating surface, being of substantially the same shape and being substantially uniformly spaced so that the row of cathodes comprises a cyclic succession of said portions of all the conductors.

2. A gas-discharge device as claimed in claim 1, wherein the portions of the conductors adjacent the cathode portions and not constituting said cathodes being covered with an electrically insulating material.

3. A gas-discharge device as claimed in claim 2, wherein the core has at least one elongate longitudinal groove in which said common anode is present.

4. A gas-discharge device as claimed in claim 3, wherein the common anode consists of electrically conductive material at the bottom of the groove.

5. A gas-discharge device as claimed in claim 3, wherein the core is an electrically conductive body the surface of which is electrically insulating with the exception of the bottom of said groove.

6. A gas-discharge device as claimed in claim 5, wherein the core is an aluminum body having an oxide surface layer, the bottom of the groove being free of said oxide layer.

7. A gas-discharge device as claimed in claim 1 wherein the conductors are arranged in grooves in the core at least adjacent each end of the cathode portions, said grooves extending substantially perpendicularly to the longitudinal direction of the anode.

8. A gas-discharge device as claimed in claim 1 wherein the common anode is a light-pervious electrically conductive layer provided on the inner wall of the envelope.

9. A gas-discharge device as claimed in claim 8, wherein each of the conductors is an electrically conductive coating substantially in the form of a helix on the insulating surface of the core.

10. A gas-discharge device as claimed in claim 8, wherein each of the conductors is a metal wire arranged in a respective groove formed between a number of adjacent filaments each having an insulating surface and equal in number to the number of conductors, each of the filaments being wound around the core substantially in the form of a helix.

* * * * *